US006718624B1

(12) United States Patent
Rohrbach et al.

(10) Patent No.: US 6,718,624 B1
(45) Date of Patent: Apr. 13, 2004

(54) METHOD FOR CONTROLLING A CABLE TREATING DEVICE

(75) Inventors: Jŏrn Rohrbach, Jengenstorl (CH); Daniel Schlosser, Thun (CH)

(73) Assignee: Schleuniger Holding AG, Thun (CH)

( * ) Notice: Subject to any disclaimer, the term of this patent is extended or adjusted under 35 U.S.C. 154(b) by 0 days.

(21) Appl. No.: 09/937,944

(22) PCT Filed: Feb. 28, 2000

(86) PCT No.: PCT/IB00/00214

§ 371 (c)(1),
(2), (4) Date: Oct. 2, 2001

(87) PCT Pub. No.: WO00/62381

PCT Pub. Date: Oct. 19, 2000

(30) Foreign Application Priority Data

Apr. 8, 1999 (CH) ..... 654/99

(51) Int. Cl.[7] ..... H01F 7/06

(52) U.S. Cl. ..... 29/605; 29/33 M; 29/525.12; 29/564.1; 140/92.2

(58) Field of Search ..... 29/605, 33 M, 29/525.12, 564.1, 564.3, 564.4, 825; 140/92.2; 242/476.6, 487.1

(56) References Cited

U.S. PATENT DOCUMENTS

| | | | | |
|---|---|---|---|---|
| 4,026,483 A | | 5/1977 | Skalleberg | 242/25 R |
| 4,172,374 A | | 10/1979 | Hagglund | 72/66 |
| 4,372,141 A | | 2/1983 | Russell et al. | 72/131 |
| 4,546,675 A | * | 10/1985 | Okada et al. | 81/9.51 |
| 4,663,822 A | | 5/1987 | Blaha et al. | 29/564.4 |
| 4,667,403 A | * | 5/1987 | Edinger et al. | 29/840 |
| 4,669,679 A | | 6/1987 | Pali | 242/80 |
| 4,675,972 A | | 6/1987 | Bappert et al. | 29/526 R |
| 4,730,779 A | | 3/1988 | Thievessen | 242/72 R |
| 4,869,437 A | | 9/1989 | Berz et al. | 242/83 |
| 4,881,393 A | | 11/1989 | Sykes | 72/27 |
| 5,063,974 A | * | 11/1991 | Buckwitz et al. | 140/92.2 |
| 5,305,508 A | | 4/1994 | Koch et al. | 29/33 M |
| 5,343,605 A | * | 9/1994 | Nazerian et al. | 29/33 M |
| 5,374,005 A | | 12/1994 | Jenkins et al. | 242/361.4 |
| 5,485,973 A | | 1/1996 | Nellessen, Jr. | 242/386 |
| 5,575,455 A | | 11/1996 | Jenkins et al. | 254/134.4 |

FOREIGN PATENT DOCUMENTS

| | | | |
|---|---|---|---|
| EP | 0 086 452 A2 | 8/1983 | E04B/1/48 |
| EP | 0 330 840 A1 | 9/1989 | B21C/47/04 |
| EP | 0 396 068 B1 | 11/1990 | D07B/7/02 |
| EP | 0 474 152 A1 | 8/1991 | H01R/43/052 |
| EP | 0 584 493 A1 | 3/1994 | H01R/43/28 |

* cited by examiner

*Primary Examiner*—Carl J. Arbes
*Assistant Examiner*—Tim Phan
(74) *Attorney, Agent, or Firm*—Davis & Bujold, PLLC

(57) ABSTRACT

The invention relates to a method for cable preparation, comprising two coupled devices (1, 2) for cable preparation, for example a cable preparation machine (1*a*) and a coiling device (2*a*). It furthermore relates to a device for carrying out the method and a system comprising a cable feed device, a cable insulation stripping device and a coiling device, all of which employ a novel program control (3, 4) in order to optimize the preparation procedure, for example the coiling, with regard to the feed values of the cable preparation machine (1*a*), so that a lower cable loading results without it being necessary to measure cable tension values.

8 Claims, 8 Drawing Sheets

METHOD FOR CONTROLLING A CABLE TREATING DEVICE

CROSS REFERENCE TO RELATED DOCUMENT

The present application is a 371 application of PCT/IB00/00214 filed Feb. 28th 2000, which claims the benefit of Switzerland Patent Application No. 654/99, filed Apr. 8$^{th}$ 1999.

FIELD OF THE INVENTION

The invention relates to a procedure according to a special coiling device and a system.

BACKGROUND OF THE INVENTION

A device for cable preparation in the context of the invention is a device for preparing a cable so that it is altered in its surface or its geometry or in its position relative to the original state. Said device generally has a first cable feed device arranged along the cable feed axis, a cable preparation tool (as a rule, at least one knife, crimping tool or thrust head or the like).Frequently, it has a second cable feed device, the two cable feed devices being capable of moving the cable in at least one first feed direction, frequently also in a direction opposite to this one first feed direction, while the cable preparation tool performs cable preparation actions between the feed movements.

Cable preparation machines are understood essentially as meaning a device for cable preparation which is intended for cutting into and/or stripping the insulation from and/or cutting to length a cable or at least one end of the cable.

The invention is not limited to such a device. It also relates to devices which merely cut through (cutter) or transport (feeder) the cable.

A coiling device is understood as meaning a device for coiling a cable. It has, as a rule, a coiling pan or a coiling plate in which or on which a coil forms and drives the coiling pan or coiling plate by means of a drive. A coiling pan corresponds to a coiling plate having a circumferential wall for laterally supporting a coil. In the following description, the two are to be understood in principle as being interchangeable. Usually, the coiling pans or coiling plates remain locally on the coiling device; in particular embodiments, such coiling pans or coiling plates may also remain connected to the coil for further processing, and they can be used as a transport base in the same way as pallets.

Coiling is understood a meaning the winding of a cable to form a coil. A coil is a cable stored in an approximately annular manner in a plurality of layers. It is generally present in a plurality of layers and has two cable ends (a cable start section and a cable end section), but as a rule no support or coil former. In the context of the invention, a cable is understood as meaning at least one electrical or optical conductor which is provided on the outside with an insulation. Typical cable preparation machines in the context of the invention are so-called "cut and strip" machines or cutters, as launched on the market by the Applicant, for example under the designation CS 9050, CS9100, PS9500 Powerstrip or OC3950.

Typical "cut and strip" machines have drive rollers, drive belts or other drive devices which transport the cable along a first-conveying axis, initially in a transport direction, and then, in the course of the insulation stripping processes, also in a direction opposite to the first transport direction, in the opposite second transport direction, in order to carry out the individual insulation stripping steps—generally at both ends of a cable section.

In the context of a preferred embodiment of the main invention, the purpose of coiling is primarily to form such long cable sections stripped at both ends or only cut off, in order to make them more easily transportable, storable or further processible.

SU-916012B describes a wire coiling machine comprising a coiling pan in which a U-shaped binding band is inserted prior to coiling, in order to bind the prepared coil before it is removed and thus to make it more easily transportable. The wire is fed through a rotating device into the pan. The design is intended as an addition to wire rolling or wire drawing devices in which, owing to the production sequence, only one feed direction occurs in each case.

U.S. Pat. No. 4,372,141 describes another wire coiling device comprising an integrated cutting device for the wire. The feed velocity of the wire is generated by two drive rollers driven by means of a gear. The feed velocity is mechanically synchronized and varies with respect to the coil operation and the cutting operation. The use of this wire coiling device as an addition to a cable insulation stripping device is not envisaged. As in the SU-B, the design operates with only one feed direction for the wire.

Another form of synchronization (cycle synchronization) between the device for cable preparation and the coiling device is indicated in U.S. Pat. No. 4,663,822 of 1987. There, a single, programmable electronic controller controls all drives. A diverter switches the cable path between two cable ducts to two selectable coiling pans. The two coiling pans are driven by a motor via a clutch which can be engaged and released as desired and alternately. The electronic controller detects the cable feed via a length sensor and the position of the cable ducts via a proximity switch. It synchronizes the drives by actuating electropneumatic control pistons. One control piston moves, for example, the cable duct between two positions assigned to the respective coiling pans. Two further control pistons operate the one clutch each between the continuously revolving motor and the coiling pans. A cyclic, synchronized sequence is thus possible provided that there are no slip or feed losses during cable preparation. In the coiling pans themselves, play is possible since the cables are introduced freely. Undesired friction and cable damage cannot be entirely ruled out. The free introduction does not make it possible to achieve exactly reproducible coil shapes.

An additional disk brake likewise controlled by the controller is provided in order to brake a rotating coiling pan as soon as it is no longer driven. This design therefore has only two operating states of the coiling pans, rotating at full speed or braked. An intelligently controlled drive having variable speeds, acceleration moments or variable brake moments or feed reversal is however not provided in spite of the electronic controller.

Apart from this, this design is fairly complicated from the point of view of operation and programming. Thus, the single controller must be operated with all parameters relevant to the result. Reprogramming must take place if peripheral devices (additional devices) are changed. However, even if only operating parameters relating to the main tool or to the feeds are changed, corresponding changes in the operating parameters of the additional devices must be programmed by the operator. This is time-consuming and by no means tolerant of errors. Before a corresponding arrangement is ready for operation, test runs should always be made, in which waste is likely under certain circumstances.

The principle of a central computer for actuating a plurality of devices for cable preparation is also applied in U.S. Pat. No. 5,343,605 of 1994. There, there is a first command bus for the up-circuit device and a second command bus for the "cut and strip" device. One command bus each runs from each of the two devices to the computer and back (status bus). Since the actuation is thus performed only by the computer, its program must always be adapted if a different device is connected.

In comparison, U.S. Pat. No. 4,546,675 describes a complete cable cutting and stripping unit having a connected coiler, the latter winding the cable onto a mandrel which can be lowered. The mandrel is lowered for coil removal. Frictional resistance between the coil and the mandrel may be disadvantageous here, and may in certain circumstances cause damage to the cable.

A support plate is moved up and down along a cable feed nozzle in order to be able to arrange the coil in an orderly fashion in a plurality of layers. A sensor measures the tension in the cable and controls the tensile force on the winding drum as a function of said tension. Thus, this older design is therefore more sensitive than the U.S. Pat. No. 822 with regard to the requirements of a cable during coiling. However, it is always reactive and can thus react only sluggishly to rapid changes in feed, which may lead to bending of the cable or to excessively high tensions in the cable. Feed reversal is not envisaged at all.

U.S. Pat. No. 4,869,437 describes a device for producing a wire coil which is wound around mandrels arranged in a circle and is simultaneously guided by an outer circle of mandrels. In order to avoid problems with the removal of a completely wound coil and for shaping coils of different diameters, the mandrels are eccentrically mounted so that they can be turned about their eccentric axis and thus release the coil both on its inner diameter and on its outer diameter. During coiling itself, only one feed direction for the wire is envisaged.

U.S. Pat. No. 4,730,779 describes an extendable coil former for the winding of paper tissue instead of mandrels arranged in a circle. After the winding, the external diameter of the coil former is reduced and the wound tissue is thus released. Teaching regarding optimal actuation of a coiling device after a cable preparation machine cannot be derived therefrom.

U.S. Pat. No. 4,172,374 describes a winding device for spring wires, having a coil former comprising two mandrels radially displaceable relative to one another (FIGS. 9 and 10). There is no indication of the use of displaceable mandrels in coiling devices.

U.S. Pat. No. 4,669,679 describes a cable cutting device having a connected coiling device with two coiling pans each having a central mandrel around which a cable is "freely" wound with the aid of conveyor belts. The cable is not loosely inserted and also not clamped in order to wrap around the mandrel but is pressed against the mandrel by the conveyor belt. Both mandrel and conveyor belt ensure feeding. This leads to winding of the cable. The wire feed nozzle travels along the height of the mandrel in order to achieve an ordered multilayer cable arrangement. The movement of the nozzle is speed-coupled to the movement of the conveyor belts. The speed of the cable feed through the cutting device and into the coiling device is kept constant. The new cable end formed in each case as a result of cutting is automatically passed into the respective other coiling pan, so that the full coiling pan can be emptied in the meantime. Since the cable preparation consists merely of cutting of the cable, here too a reversal of feed direction is not taken into account.

In order to avoid the bending of the cable, spring flaps which prevent bending of the cable are arranged in feed ducts. The coil former can likewise be reduced in its external diameter in order to permit easy removal of the coil.

This U.S. Pat. No. 4,669,679 moreover cites the extensive prior art which is also considered to have been cited in this Application.

Furthermore, the following publications from the prior art have been taken into account: EP-B330840, U.S. Pat. No. 4,881,393, EP-A584493, EP-B396068, EP-A-86452, which however offer no significant solutions to the problem mentioned below.

A coiling device having a cutting means (not "cut and strip" but only a "cutter") is described in U.S. Pat. No. 4,026,483. It has a gear-controlled feed nozzle which applies the cable in a controlled manner, layer by layer, onto the coil former. Here too, the cable runs only in one feed direction.

U.S. Pat. No. 5,063,974 describes an automatic wire cutting, coiling and binding system for the production of multiple wire bundles, in which, inter alia, a motor-operated coiling device with a pneumatically operated clamping device is intended to wind the wire end around the mandrel. A guide roller which has an annular guide groove for a wire is also provided in order to guide said wire as a function of the desired internal diameter of the coil. A stripping device is not provided. The sequence can therefore take place without problems, owing to the lack of a back-and-forth movement of the wire. The rotational speed of the coiling device can—in the absence of a change of feed direction—easily be tailored to the feed velocity.

Another form of clamping of the wire or cable end occurs in a coiling device from Ramatech, in which a clamping fork with conically converging clamping bows takes up the cable end. The clamping bows are self-locking but their clamping point is not positively defined, so that the cable can also slip through. Moreover, the Ramatech arrangement requires manual threading of the cable end into the clamping device.

U.S. Pat. No. 5,374,005 and U.S. Pat. No. 5,575,455 describe a coiling device in which an optical glass fiber is coiled in a coiling pot by blowing it by means of an air blast out of a nozzle into the rotatable pot and placing it there loosely around a mandrel. This method can be used only for thin, light cables. The coil obtained in each case is not exactly reproducible.

U.S. Pat. No. 5,485,973 describes a comparable system for thicker cables, which are placed via a gooseneck means from the center of a coiling pot in a rotary manner in said coiling pot. However, this is not a coiling system for the production of removable coils but a cable store. A pressure roller presses the inserted cable rings against the baseplate so that they are layered as tightly as possible. Without the pressure device, systematic filling of the cylindrical cavity of the coiling pot would not be possible. Owing to the gooseneck means and the pressure device, removal of a coil or of a Wound cable is not possible.

EP-A-474152 describes a cable preparation machine in which a pivotable, tubular cable guide means swivels a cable from one preparation station to a downstream preparation station. Such cable guides are also used in known coiling devices having more than one coiling pan.

U.S. Pat. No. 4,669,679 describes, for example, such a coiling device having two coiling stations so that, while a coil is being removed from one station, a subsequent coil is produced in the other coiling station. There, however, it is not the cable guide duct which is moved but an upstream diverter, in order to feed the cable to the correct coiling pan in each case.

SUMMARY OF THE INVENTION

The Applicant launched, under the designation CP1250, a free-standing coiling means which likewise has two coiling pans into which cables can be alternately introduced likewise via two separate guide tubes with upstream diverter. The coiling pans are caused to rotate under motor power so that cables introduced are carried along due to the friction against the coiling pan wall and are laid in a coil. Mandrels are mounted in the center of the coiling pans and make it impossible for the cable to be laid in a form deviating from a circle. The drive of the coiling pans is adjustable so that each user can choose his "optimum" speed. This is as a rule set slightly faster than would necessarily be required in relation to the laying speed or speed of introduction of the cable into the coiling pans. This is a safety aspect for reliably preventing stopping of the cable feed and bending of the cable.

The CP1250 thus differs from other conventional coiling means, which attempt to adapt the rotational speed of the coiling pans or other winding means to the requirement, in that, for example, the cable tension is measured and the drive is accelerated (tension decreases) or braked (tension increases) on the basis of the result of the measurement.

Both known methods are thus indirectly based on the processing speed upstream of the coiling means. As mentioned, in the CP1250, for example, faster rotation is chosen than would result from the preceding processing; the tension measuring systems react, by means of a control loop, to changes in the delivery speed which are detected by changes in the tension, and the speed is adapted.

Both known methods have disadvantages: whereas one method involves slip with associated friction which can lead to traces of abrasion on the cables, the other method may result in irregularities, bending or undesired tautness if the control loop reacts too slowly. An abrupt strain can adversely affect the mechanical, electrical or optical properties of a cable.

It is thus the object of the invention to provide a novel method and novel device which avoids the known disadvantages and permits uniform, accurate actuation of two or more devices for cable preparation, for example of additional devices on "cut-and-strip" machines, and which permits, for example, the reproducible laying of a cable without tension or with a defined tension and does not have other disadvantages known from the cited prior art.

The invention is not restricted to combinations of insulation stripping machines with coiling machines. It relates in general to cable preparation machines having functions as stated in the claims. Because preparation devices for cables are basically independent of one another and because a program control is assigned to each one, the invention adopts a completely new approach. The main advantage is the absence of the repeated reprogramming of the program control of the insulation stripping machine previously treated as the main device.

Thus, it is possible to connect to a device for cable preparation various additional devices which fetch the required information from the first device and optionally feed back this status information, without however necessarily being controlled in a rigid "master-slave relationship" by the first program control. In the invention, the "master-slave relationship" can if required be reversed, also several times in succession, or can be completely dispensed with. Thus, for example, a standard command "feed 10 m/s" in a first program control for the feed drive on a "cut and strip" machine can either accelerate the drive for rotational movement of a coiling pan to a comparable feed velocity in a coiling device connected downstream via an interface, by means of a second program control (slave relationship). However, it is also possible, for example, for the second program control to independently report back to the first program control: "This feed is too fast for a coiling process, reduce the speed to half the value" (master relationship).

The invention relates not only to the control aspects of insulation stripping devices but also to novel embodiments of a coiling device, which could in principle also be applied independently of the control aspects.

For example, positive gripping and clamping of the cable ends in a coiling device - which need not necessarily have the same appearance as a conventional coiling pan but, for example, can also manage without lateral walls, such as, for example, a coiling plate—and further improvements to coiling devices are described. Below, reference is made in each case to "coiling pans", which also includes "coiling plates" or the like.

In the program control of a coiling device drive as a function of the program control of the cable drives of an upstream device for cable preparation, the characteristic properties or movement sequences of the device for cable preparation or of the transported cable, such as, for example, inertia, startup and braking behavior, feed and withdrawal, etc., are particularly important.

By means of the invention, any desired feed directions are possible and startup ramps and the like are also taken into account. This leads to a reduced level of malfunction and to accurate coiling. The coils are reproducible independently of the preceding cable preparation and are more uniform than was possible in the past.

According to a particular embodiment of the method, the program is programmable so that, together with the programming of the cable preparation machine, the drive of the coiling device can also be freely programmed.

According to a particular embodiment of the invention, the one particular data transfer unit—in this case in the form of an interface between the two connected devices (e.g. a FIELD BUS,in particular a CANBUS—preferably CAN-SELECTRON—PROFIBUS, INTERBUS-S, AS-BUS, LON, ARCNET, EIB, ETHERNET)—enables the status information to be delivered from the main device to the additional device and vice versa, for example from the coiling device to the program control of the first device for cable preparation and from there to a display. In the text below and in the patent claims, reference is always made only to the FIELD BUS, but this includes all abovementioned BUS systems.

In principle, the additional device (for example the coiling device) or its program control is programmed on a separate keyboard. Optionally, however, program commands of the first device for cable preparation are also possible via the data transfer unit or via the interface and the first program control, so that both these and simultaneously the coiling device drive can be programmed from the keyboard of the device for cable preparation, and the settings of the coiling device drive can also be shown on any display present. On the other hand, the invention relates to variants having a separate display on the additional device, on which, for example, status values of the main device which are delivered directly via the interface can also be displayed.

In the case of the coiling device drive according to the invention, in contrast to the known prior art, it is therefore not synchronized actuation of device for cable preparation and coiling device that is important but intelligent actuation of the coiling device so that it operates completely compatibly with the cable preparation machine. This means that non-synchronized movement of the coiling device is also entirely possible. Thus, for example, when the starting of the insulation stripping machine is known in advance, the coiling pan can already be set into motion under program control by the electronics in order thus to prevent pressure/tension peaks of the cable fed in.

The invention thus also relates to table-supported startup ramp controls for the coiling device drive, which help optimally to reduce the tension changes in the cable. The invention thus relates, in particular embodiments, also to braking and speed reversal modes for the coiling device drive, etc.

Further improved solutions with more highly developed user safety and greater advantages compared with the prior art are evident from further technical details of the novel coiling device.

A controlled cable clamping device ensures secure clamping of the cable end or cable beginning and permits the production of reproducible coils. Fully automatic coiling is possible if, according to a further development of the invention, the cable feed to the coiling device is program-controlled and/or position-controlled and/or sensor-controlled. This is advantageous in particular for binding of the coil in the correct position.

A sensor according to the invention has a controlled geometrical relationship with the coiling pan or with the coiling plate. Preferably, it is mounted on a sensor arm which has a specific geometrical relationship with a program-controllable cable feed duct, so that it can, for example, monitor or feed back the result of the cable feed through the cable guide duct. Apart from this, it would also be possible for such a sensor, according to a particular development, to determine and control the geometric design of a cable and/or of a coil. Preferably, sensor arm and cable guide duct are present on a common axis but axially displaced relative to one another.

The interplay between cable feed duct and drive for coiling pan or coiling plate is designed, according to the invention, so that, after the coil has been completed, the free cable end a piece can remain temporarily in the cable feed duct. Thus, both the beginning of the coil and the cable end are geometrically specified in a reproducible manner under program control and held in a stable fashion in its shape, which facilitates the binding and automatic further processing of the coil (for example transporting).

In a further development of the invention, mandrels known per se are preferably provided as radially displaceable mandrels which guide the wound coil without tension during removal. Preferably, either the mandrels too can be capable of being lowered or a baseplate which carries the coil can be designed so as to be capable of being raised, so that mandrels and baseplate move relative to one another and the coil is thus more readily removable. The raising of the baseplate may be preferable in that the coil is thus lifted toward the operator, which facilitates its removal.

The sensor-controlled determination of the increasing coil diameter, provided according to a further development, permits the automatic control of the speed of the coiling pan drive in order to adapt the cable speed at the coiling device to the speed of the cable preparation machine. As an alternative to the measurement of the coiling diameter, for example by means of a light barrier, it would also be possible, for example, to use the respective power consumption at the coiling pan drive as a measure for the speed regulation. Methods known per se, such as the measurement of the tension in the cable, would also be possible, but owing to the longer reaction time, are not preferred.

Double coiling devices known per se permit continuous cable preparation and coiling, a novel diverter, which would also be usable independently of the other features of the invention, preferably being used. Instead of known diverters which had a single feed hopper with two different exits, one or other of which was brought into position by pivoting of the diverter, two independent cable guide ducts are now provided, with program control, each of which is positioned opposite the cable exit of the cable preparation machine—in particular by vertical or horizontal displacement. In this way, greater operational safety is achieved and jamming or incorrect passage of the cable is avoided.

According to a particular embodiment, the cable diverter can also be removal manually or under motor power, so that any waste can be automatically ejected. At least manual removal facilitates cable insertion and service work.

A motor-controlled and preferably sensor-controlled cable guide arm according to the invention increases the coil quality since it effects coil build-up in cooperation with the rotating coiling device under program control. A multilayer structure as well as positioning of the second cable end or of the cable section end are thus optimally achieved. Particularly in combination with novel detection, according to the invention, of the precise rotational position of the coiling device, such positioning of the end of the coil for removal purposes is possible in a simple manner.

In the context of the invention, the arrangement of two devices for cable preparation is not limited to the serial arrangement of these devices, so that cable preparation takes place in succession along a general feed line. In particular, parallel cable preparation, in which, for example a cable is laterally displaced or swivelled from its general feed line and is prepared there by another device for cable preparation and then swivelled or displaced back to the feed line are also included.

BRIEF DESCRIPTION OF THE DRAWINGS

Further improvements and details according to the invention are evident from the drawing, which shows an embodiment according to the invention.

DETAILED DESCRIPTION OF THE INVENTION

Figure 1:
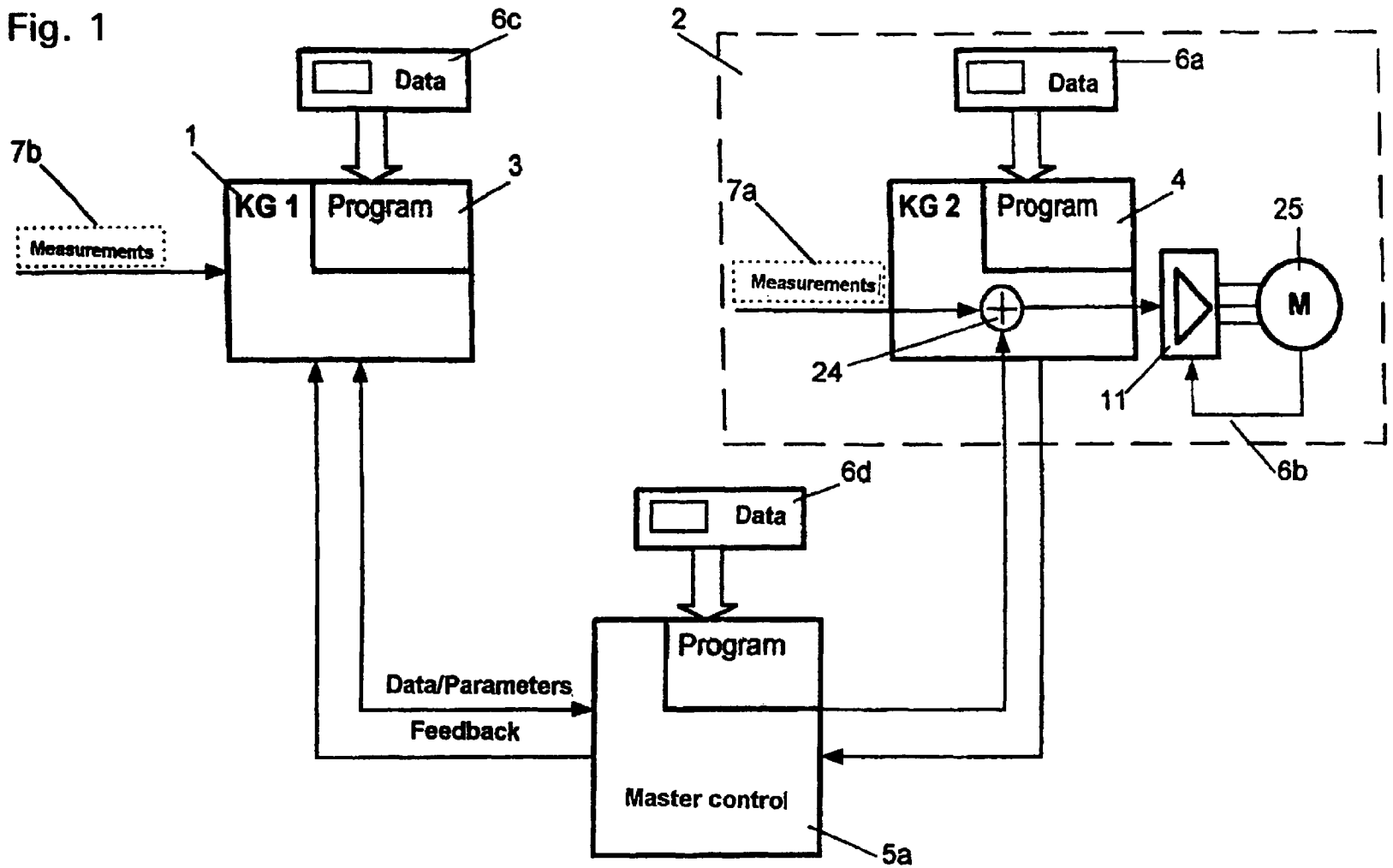
FIG. 1 shows a flow diagram of a setup according to the invention, comprising a program control (computer) as data transfer unit.

The Figures are described in relation to one another. Identical parts are given identical reference numerals. Functionally identical parts are given identical reference numerals with different indices. The Figures represent only a preferred embodiment and do not limit the scope of protection of the patent claims and the disclosure of the Application. The attached list of reference numerals is part of this description of the Figures. Together with the other parts of the description and with the information in the patent claims, it supplements the disclosure of the inventive teachings.

Figure 2:
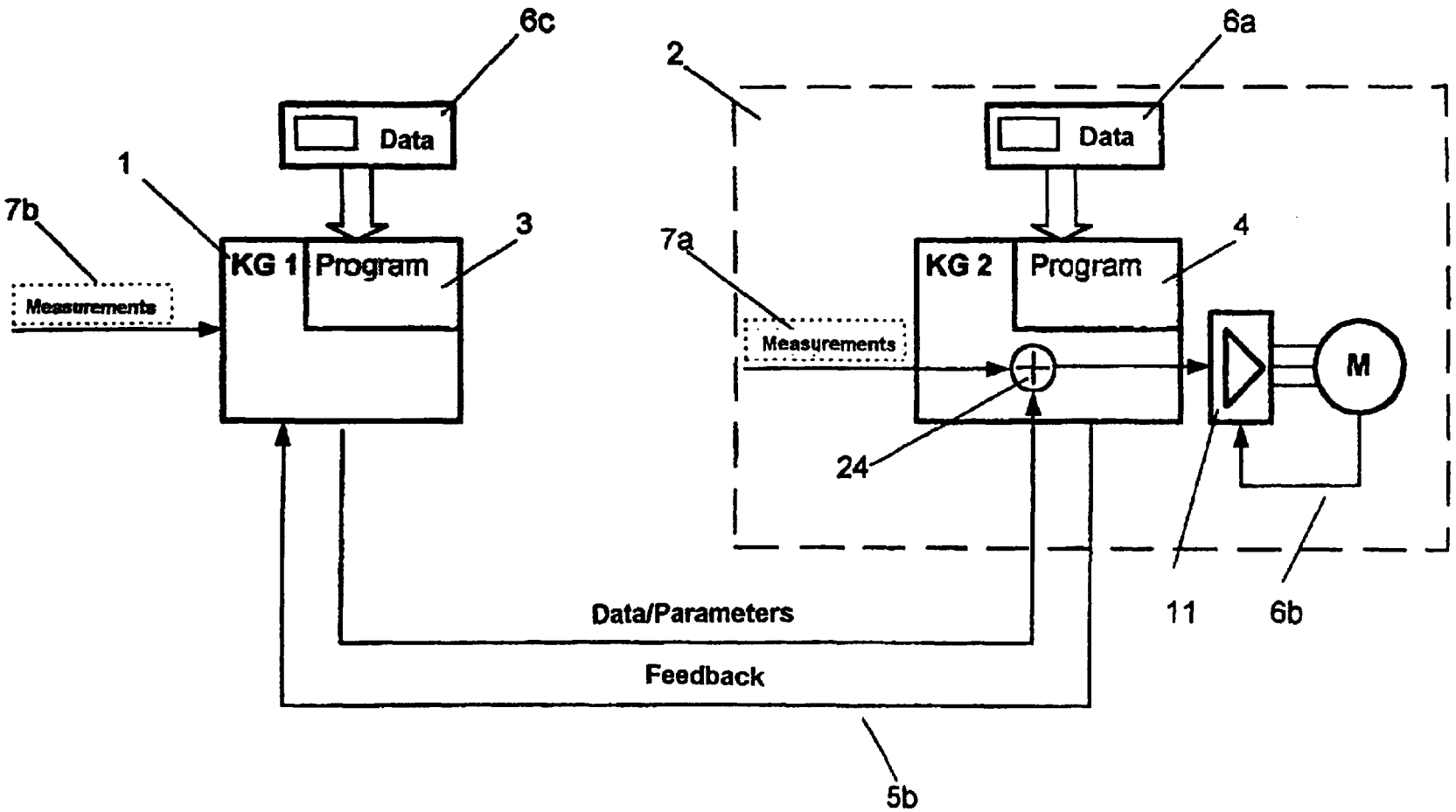
FIG. 2 shows a comparable flow diagram comprising an interface as data transfer unit.

FIG. 1 and FIG. 2 illustrate an overriding principle of the invention: two devices 1 and 2 for cable preparations which have basically equal authorization (several may also be present, but this is not shown) are connected or can be connected to one another by a data transfer unit 5*a* (separate program control or computer) or 5*b* (special interface, e.g. FIELD BUS, etc.). Each of the devices 1, 2 for cable preparation comprises a separate program control 3, 4 in contrast to the known device with a central program control in the main device. These program controls 3, 4, 5*a* can be influenced by any keyboards 6*a*, 6*c* or 6*d* provided, or the like. Furthermore, they can, if required, be influenced by measured data fed in from sensors or the like (7*a*, 7*b*).

As one of the innovations, the second program control 4 comprises a program with computational operations (indicated by 24 ) which calculate control data for the second device 2 for cable preparation from pure status or parameter data from the first program control 3. These control data are fed to a control 11 , which actuates, for example, a drive 25. The drive 25 receives feedback via a symbolically illustrated control loop 6*b* or the like, so that, if required, the real drive data are made available by the data transfer unit 5*a* or 5*b* as status information of the first program control 3 for information purposes.

In the context of the invention, the first program control 3 could, as shown for the second program control 4 , likewise have corresponding computational operations (24), although this is not described in this example.

In this embodiment, the symbolic keyboard 6*d* in FIG. 1 makes it possible to influence the data transfer between the two devices 1 and 2 for cable preparation.

Figure 3:
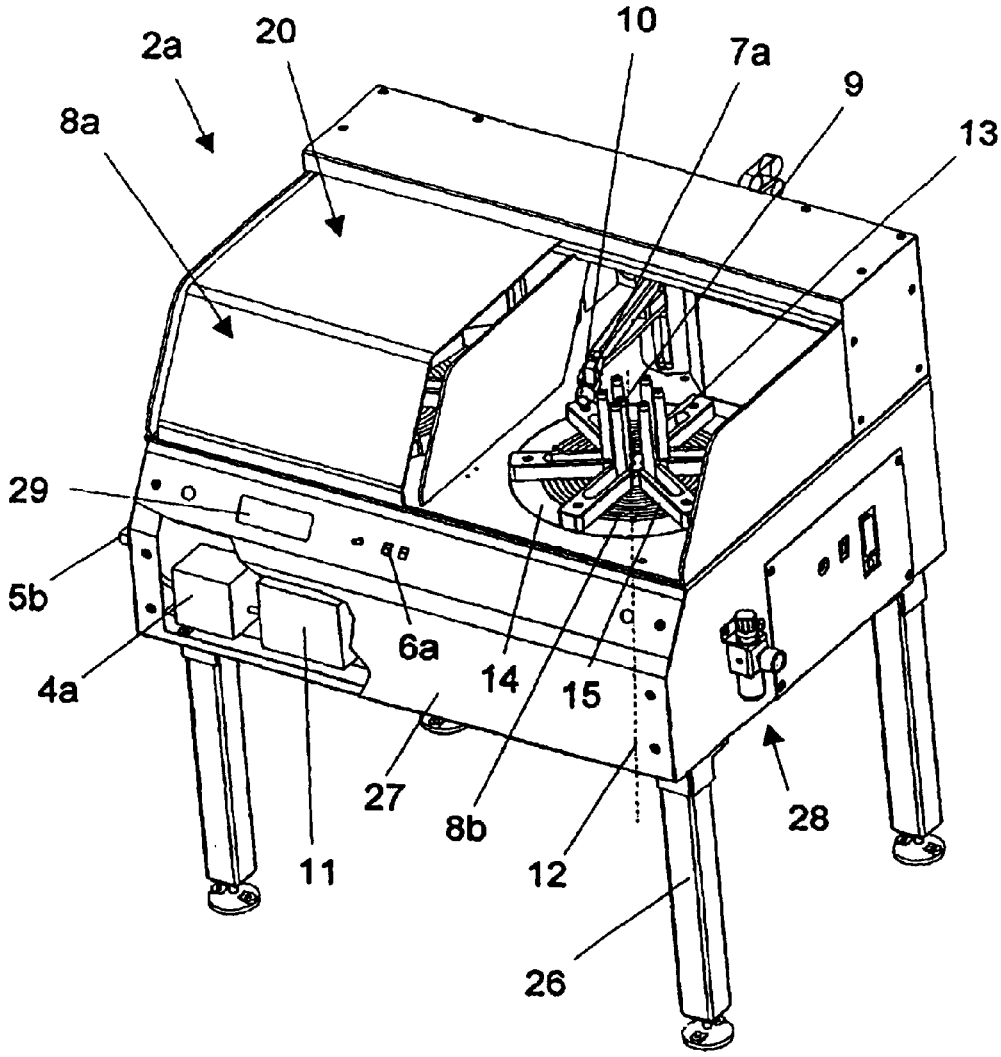
FIG. 3 shows an oblique view of a coiling device according to the invention.
Figure 4:
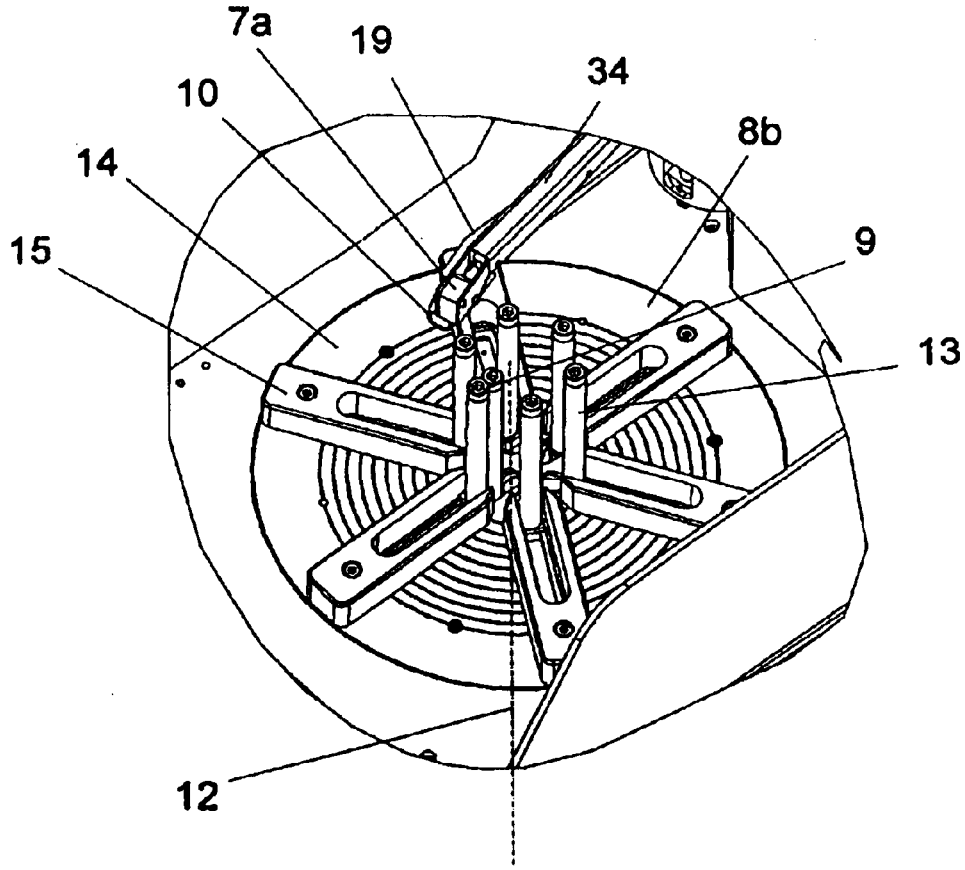
FIG. 4 shows an enlarged detail from FIG. 3: a coiling plate.

FIG. 3 shows a coiling device 2*a* on a frame 26, which coiling device is designed according to the invention. It comprises a housing 27, a connection field 28 for the energy connection (power, compressed air or the like), a display 29 , a keyboard 6*a*, a symbolically indicated program control 4*a* having an interface. 5*b*, a control 11, two coiling plates 8*a* and 8*b* and a cover 20, which covers either one coiling plate 8*a*—as shown—or the other coiling plate 8*b*. A safety circuit prevents the coiling operation of a coiling plate 8 if the cover 20 is absent.

Figure 6:
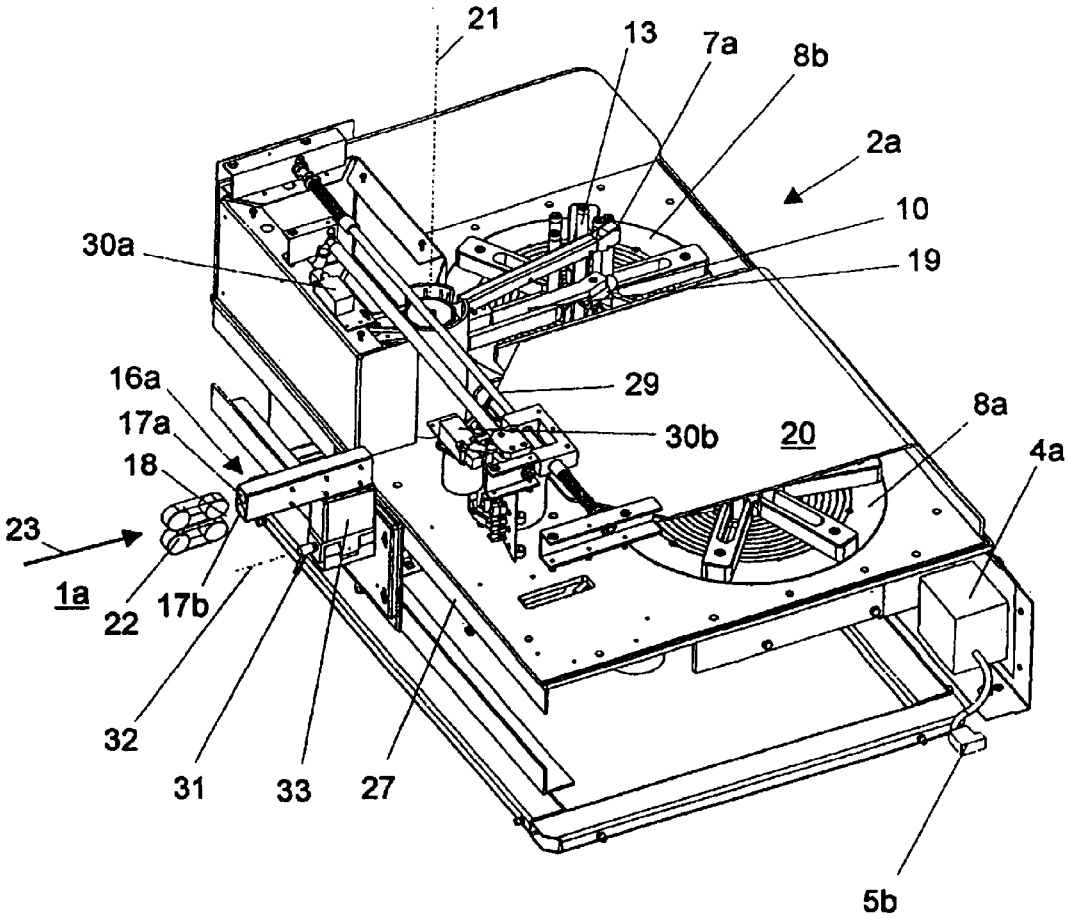
FIG. 6 shows an oblique view of the coiling device of FIG. 3 from the back, with partly covered housing parts.
Figure 7:
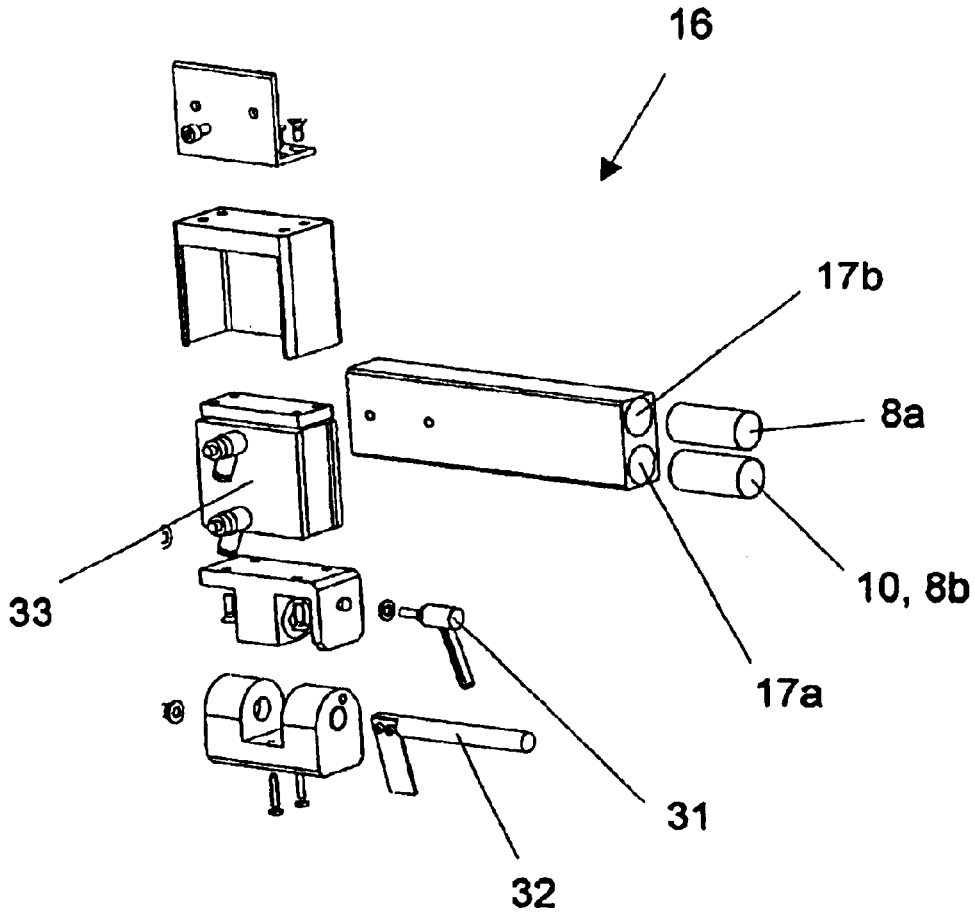
FIG. 7 shows a detail from FIG. 6: a cable diverter with cable feed ducts
Figure 8:
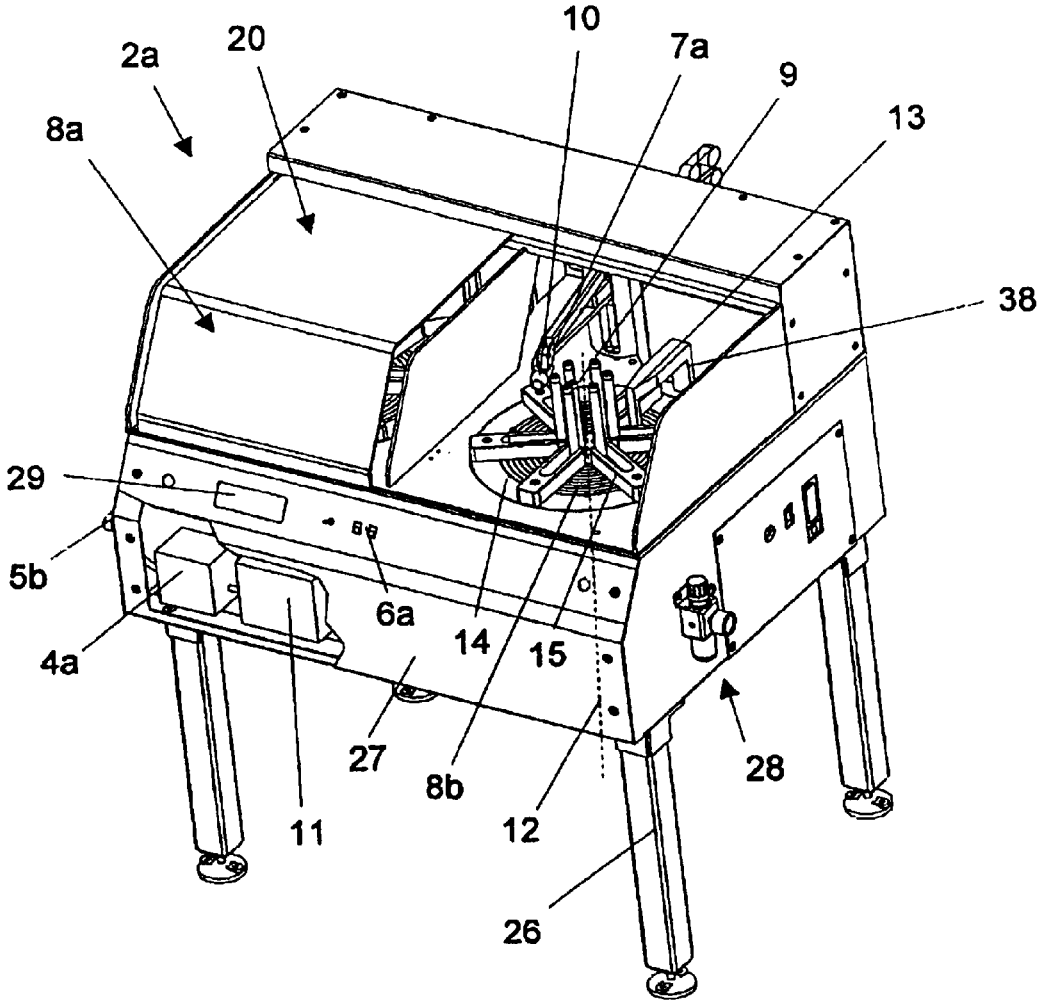
FIG. 8 shows a setup according to FIG. 3 with integrated binding device.

The cover 20 is motor-driven via a spindle shaft 29, as shown in FIG. 6. Two limit switches 30*a* and 30*b* are part of the safety circuit according to the invention.

In the rear part of the coiling device 2*a*, a cable diverter 16 is mounted on the housing 27 and can be swivelled out according to the invention. For this purpose, a toggle lever 31 is releasable, whereupon the cable diverter 16 can be tilted about an axis 32 of rotation. As a result of this tilting, the two cable feed ducts 17*a* and 17*b* are removed from the region of the exit 18 of a cable preparation machine 1*a*. In the tilted-in state, one of the two cable feed ducts 17*a* or 17*b* is always opposite the exit 18. A motor-operated adjustment means 33 (controlled by compressed air or electrically) ensures, under program control, the correct positioning of the cable feed ducts 17*a* or 17*b*, which are each connected at the other end to a cable feed arm 10, of which one is coordinated with the right coiling plate 8*b* and the other with the left coiling plate 8*a*.

The coiling plates 8 comprise a base 14 which, in this embodiment, carries (not necessarily) removable spacers 15. A coil rests on these spacers 15 so that an operator or a transport device or a binding device can grip under the coil. Said coiling plate furthermore comprises motor-driven (pneumatically actuated) mandrels 13 which are shown in the coil removal state. In the winding state, these mandrels 13 are moved radially outward so that they define the internal diameter of the coil. One of the mandrels 13 cooperates with a cable clamping device 9 which can clamp a cable end under program control in order exactly to define the beginning of the coil.

The cable feed arm 10, which is connected to the cable feed duct 17*b* via a plastic tube, is spatially coordinated with the coiling plate 8*b*. A comparable arrangement is also provided in the case of the coiling plate 8*a*. The raising or lowering of the cable diverter 16 thus produces a connection from the exit 18 to the cable feed arm 10 or to the cable feed arm in the case of the coiling plate 8 a.

The cable feed arm 10 is mounted on a cable guide arm 19 which is pivotable about an axis 21 under program control—in a manner comparable with a phonograph arm. It is also optionally controllable in its height. This makes it possible to wind a coil under program control.

This winding process is monitored by an optical sensor 7 a on a sensor arm 34 which is mounted, axially displaced relative to the cable guide arm 19, on the same axis.

Figure 5:
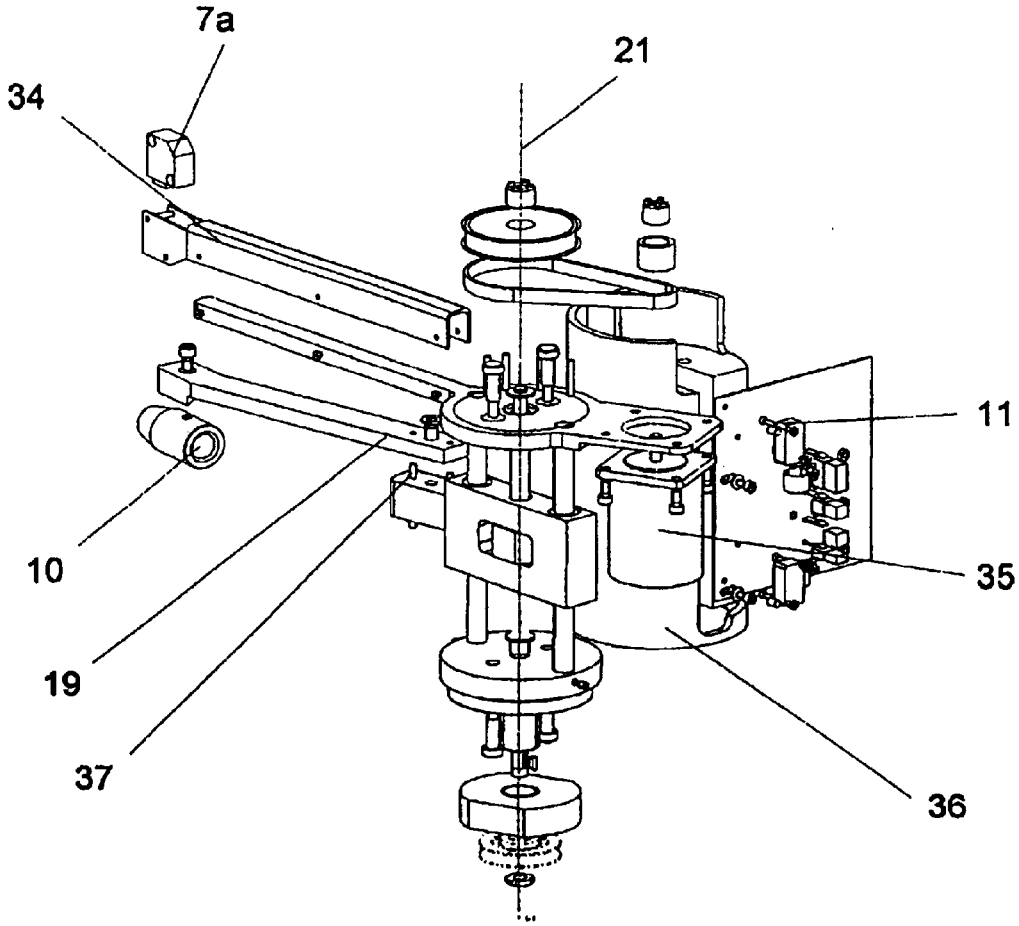
FIG. 5 shows an enlarged and exploded detail from FIG. 4: a cable duct and a sensor arm.

FIG. 5 shows the exploded structure of this embodiment with its pivot drive 35, its housing 36 and the control 11 for the pivot drive 35 and further drives of the coiling device 2*a*.

The cable guide arm 19 can be mounted on the top or bottom of a holder 37. According to the invention, the height of the holder 37 corresponds to the height of the spacers 15, so that the cable guide arm 19 is mounted on the top or bottom of the holder 37, depending on the presence of the spacers 15.

The cable preparation machine 1*a* is indicated only symbolically in FIG. 6 with a cable feed unit 22. It can be formed, for example, by a "cut and strip" machine, for example a Powerstrip 9500 of the Applicant.

List of Reference Symbols

| | |
|---|---|
| 1 | First device for cable preparation |
| 1a | Cable preparation machine, cable insulation stripping machine |
| 2 | Second device for cable preparation; |
| 2a | Additional device, further processing device, coiling device, stacking or unwinding device |
| 3 | First program control |
| 4 | Second program control |
| 4a | Program control of the additional device (coiling device) |
| 5 | Data transfer unit |
| 5a | Third program control (computer); |
| 5b | Interface |
| 6 | Data sources, e.g. data input units, such as |
| 6a | e.g. keyboard on second device for cable preparation |
| 6b | e.g. control loop feedback |
| 6c | e.g. keyboard on first device for cable preparation |
| 6d | e.g. keyboard on third program control |
| 7 | Sensor |
| 7a | Sensor on second device 2 for cable preparation |

-continued

| | |
|---|---|
| 7b | Sensor on first device 1 for cable preparation |
| 8 | Coiling plate |
| 8a | left |
| 8b | right |
| 9 | Clamping device |
| 10 | Cable feed arm |
| 11 | Control for additional device |
| 12 | Axis of rotation of the coil |
| 13 | Mandrels |
| 14 | Base |
| 15 | Spacer |
| 16 | Cable diverter |
| 17 | Cable feed duct |
| 17a | for right coiling plate 8b |
| 17b | for left coiling plate 8a |
| 18 | Exit from cable preparation machine 1a |
| 19 | Cable guide arm |
| 20 | Cover |
| 21 | Axis for cable guide arm |
| 22 | Cable feed unit |
| 23 | Cable feed direction (arrow) |
| 24 | Computational operation(s) |
| 25 | Drive |
| 26 | Frame |
| 27 | Housing |
| 28 | Connection field |
| 29 | Spindle shaft |
| 30 | Limit switch |
| 30a | right |
| 30b | left |
| 31 | Toggle lever |
| 32 | Axis of rotation |
| 33 | Motor-operated adjustment |
| 34 | Sensor arm |
| 35 | Pivot drive |
| 36 | Housing |
| 37 | Holder |
| 38 | Cable binding device |

What is claimed is:

1. A method for preparation of a cable, the method comprising the steps of:

providing a first cable preparation device (1) and at least one second cable preparation device (2);

operating the first cable preparation device (1) according to a first program control (3), and operating the at least one second cable preparation device (2) according to a separate, second program control (4) spatially separated from the first program control;

connecting the at least one second cable preparation device (2) to the first cable preparation device (1) via a data transfer unit (5);

transferring data from the first program control to the second program control via the data transfer unit;

receiving all the transferred data in the second program control and selecting only a desired portion of the transferred data as control data for the second program control for controlling the second cable preparation device (2) during operation; and feeding at least a part of the control data for the second program control (4) back via the data transfer unit (5) to the first program control (3).

2. The method according to claim 1, further comprising the steps of selecting a third cable preparation device from the group of:

a) a coiling device **(2*a*) having a coiling pan or coiling plate (8*a*)**, b) a wire stacker (cable stacker), c) a prefeeder (cable unwinding unit), d) a cable marking device, e) a device for cable end preparation, comprising the operations of twisting, fluxing, tin-plating, soldering, welding, crimping, pressing-on of contacts or sleeves, mounting of seals, plug housings on the cable end, f) a device for cable layer preparation comprising mechanical or thermal tools, g) a cable transport device, h) a binding device, and effecting at least one of a preliminary, parallel and subsequent cable processing step based on the selected third device for cable processing.

3. The method according to claim 2, further comprising the steps of:

selecting the coiling device as the third device for cable processing;

gripping the cable in the coiling device **(2*a*) with a clamping device (9)** connected to the coiling device and clamping the cable;

effecting acceleration and rotary movement of the cable with the coiling device **(2*a*) in one of a feed direction (23)** and an opposite direction to the feed direction during processing of the cable according to the second program control;

producing one of a programmed tensile load on the cable within a defined tension range throughout the entire processing of the cable without any direct measurement of a cable tensile load, and a geometrically defined, tension-free laying of at least one cable end and cable windings of the coil during processing according to the second program control.

4. The method according to claim 2 further comprising the steps of:

maintaining the rear end of a coiled cable in a cable feed arm (10) upon completion of cable processing; and rotating the coiling plate into a desired position wherein the ends of the cable comes to rest in a specific, preprogrammable position.

5. The method according to claim 4 further comprising the steps of:

arranging a position detection sensor (7) on the coiling plate (8);

controlling a coiling plate drive so that a rotary position of the coiling plate (8) can be fixed for cable feed, laying at least one of the cable ends of the coil in a defined position for removal or binding of the cable by one of a cable guide arm (19) and a rotary positioning of the coiling plate (8) according to the second program control **(4*a*)**.

6. The method according to claim 5 further comprising the step of controlling the coiling plate drive according to at least one of tables and computational instructions with data for startup ramp controls.

7. The method according to claim 5 further comprising the steps of providing a braking mode to the coiling plate drive and equipping said coiling plate drive with a power consumption sensor which, during operation, monitors the power consumption of the coiling plate drive and feeds back the values for control purposes to the second program control.

8. The method according to claim 5 further comprising the step of positioning the third device for cable preparation is positioned one of upstream, downstream and parallel of the first device for cable preparation.

* * * * *